US007845587B2

(12) United States Patent
Fuller et al.

(10) Patent No.: US 7,845,587 B2
(45) Date of Patent: Dec. 7, 2010

(54) PULVERIZER UPPER GEARBOX BEARING ASSEMBLY

(75) Inventors: Mark A. Fuller, Canton, CT (US); Robert S. Prairie, Vernon, CT (US)

(73) Assignee: ALSTOM Technology Ltd, Baden (CH)

( * ) Notice: Subject to any disclaimer, the term of this patent is extended or adjusted under 35 U.S.C. 154(b) by 18 days.

(21) Appl. No.: 12/409,872

(22) Filed: Mar. 24, 2009

(65) Prior Publication Data

US 2009/0242676 A1 Oct. 1, 2009

Related U.S. Application Data

(60) Provisional application No. 61/072,228, filed on Mar. 28, 2008.

(51) Int. Cl.
*B02C 15/00* (2006.01)

(52) U.S. Cl. ..... 241/101.3; 241/117

(58) Field of Classification Search ..... 241/117–121, 241/101.3

See application file for complete search history.

(56) References Cited

U.S. PATENT DOCUMENTS 4,210,251 A * 7/1980 Grussen ..... 215/329
5,944,270 A * 8/1999 Farris ..... 241/119
6,024,311 A * 2/2000 Prairie et al. ..... 241/117

* cited by examiner

*Primary Examiner*—Mark Rosenbaum
(74) *Attorney, Agent, or Firm*—Lawrence P. Zale

(57) ABSTRACT

A pulverizer upper gearbox bearing assembly for a mill includes a bowl hub having a stepped hub defining a first bore to receive a shaft therethrough and a bowl extending radially outwardly therefrom defining a cavity between the stepped hub and bowl, the stepped hub having a first outside diameter extending to a second outside diameter, which in turn extends to a third outside diameter along a longitudinal axis of the first bore, the first outside diameter larger than the second outside diameter, which is larger than the third outside diameter; a thrust bearing disposed around the first outside diameter, the thrust bearing having an upper washer and a lower washer, the upper washer having an interference fit with the first outside diameter of the bowl hub; a roller bearing disposed around the third outside diameter, the roller bearing having a separable inner ring from an outer ring and a surrounding cage and roller assembly; a mill base hub extending into the cavity between the bowl and stepped hub, the mill base hub defining a first inside diameter extending to a second inside diameter, which in turn extends to a third inside diameter along a longitudinal axis of the first bore, the first inside diameter larger than the third inside diameter, which is larger than the second inside diameter; and a fluorocarbon rubber oil seal disposed in an annulus of an edge defining the first inside diameter of the mill base hub. The upper washer of the thrust washer is disposed between the first outside diameter of the base hub and the oil seal and first inside diameter of the mill base hub. The second outside diameter of the bowl hub is inside and aligned with the second inside diameter of the mill base hub. The third outside diameter of the bowl hub has an interference fit with the inner ring of the roller bearing, and the third inside diameter of the mill base hub allows the outer ring, cage and roller assembly of the roller bearing to fit therein allowing removal of the bowl hub, inner ring, upper washer and shaft from the mill base hub.

13 Claims, 7 Drawing Sheets

PULVERIZER UPPER GEARBOX BEARING ASSEMBLY

CROSS REFERENCE TO RELATED PATENT APPLICATION

This application claims priority to co-pending U.S. provisional application entitled, "PULVERIZER UPPER GEARBOX BEARING ASSEMBLY," having U.S. Ser. No. US 61/072,228, filed Mar. 28, 2008, the entire contents of which are incorporated herein by reference.

TECHNICAL FIELD

This invention relates generally to coal pulverizers. More particularly, the present invention relates to an upper gearbox bearing assembly for upgrading or retrofitting ring-bowl (RB) coal pulverizing mills.

BACKGROUND

Ring-bowl (RB) mills are used in coal-fired furnaces because pulverized coal burns substantially like gas and, therefore, fires are easily lighted and controlled. Pulverized coal furnaces can be readily adapted to burn all coal ranks from anthracite to lignite.

When in operation, raw coal enters the pulverizer through a center feed pipe onto a rotating bowl. Centrifugal force causes the coal to move outward from the center and under journal assemblies, where the coal is crushed by large rolls. The partially pulverized material passes over the rim of the bowl, where the coal is entrained by a rising hot-air stream and pyrites and tramp iron that enter the mill with the coal fall into the millside. The rejected materials are swept out of the mill into an external hopper. The air-transported partially pulverized coal is classified on the basis of size, with the larger, heavier particles being returned to the bowl and coal having the desired particle size exiting the pulverizer.

Referring to FIG. 1, the rotating bowl is gear driven by a gear unit (e.g., gearbox) 2 disposed below and external to a mill housing 3. Since the gear unit 2 does not penetrate the mill housing 3, it is not directly exposed to the pulverized coal entrained in the primary air. A mill-housing penetration seal 5, above the gear unit 2 prevents airborne coal particles from settling into the gear unit 2. Conventionally, the mill-housing penetration seal includes a mill base seal ring 5 disposed between the movable grinding-bowl support hub (bowl hub) 4 and a stationary mill base hub 6. In addition, a mill base hub bushing 7 and thrust bearing 8 are disposed between the movable bowl hub 4 and a stationary mill base hub 6. This mill base hub bushing 7 is typically a bronze bushing.

With a switch to Powder River Basin (PRB) coal, e.g., from Powder River Basin, Wyoming, many older RB suction mills are reaching their thermal limits when trying to make rated capacity and are running close to positive pressure under the bowl. Taking a derate is not an option at many plants. To assist in drying the coal during wet and cold times of the year, many plants add duct burners to the system. However, this can add a significant heat load to the mill. The bowl hub 4 and mill base hub 6 conducts this additional heat load, especially if the millside 9 is not lined, as is the case with many of these older units.

A positive pressure underbowl condition forces coal past the existing mill base seal ring 5 and causes excessive coal contamination of the upper thrust bearing 8 and gearbox lubricant. These conditions can lead to premature failure of the upper thrust bearing 8 and coal contamination of the entire gearbox 2 and all of the gears and bearings in the gearbox.

The additional heat provided by the duct burners can also cause rapid oxidation of the lubricant in the gearbox, especially near the upper thrust bearing 8. This oil degradation can lead to rapid failure of the upper thrust bearing 8 and damage to the other bearings and gears in the gearbox.

In extreme cases, the thermal gradients caused by firing the duct burners is large enough to cause the bronze mill base hub bushing OD to expand faster than, and interfere with, the stationary mill base hub ID. The faster expansion of the mill base hub bushing OD causes a lock-up and failure of the entire gearbox unit.

Accordingly, there is a desire to improve the bearing/sealing interface between the mill base hub 6 and bowl hub 4 to prevent a lock-up and failure of the entire gearbox unit caused by additional heat load, as well as to further prevent coal contamination in the gearbox unit.

SUMMARY

According to the aspects illustrated herein, there is provided a pulverizer upper gearbox bearing assembly for a mill that includes a bowl hub having a stepped hub defining a first bore to receive a shaft therethrough and a bowl extending radially outwardly therefrom defining a cavity between the stepped hub and bowl, the stepped hub having a first outside diameter extending to a second outside diameter, which in turn extends to a third outside diameter along a longitudinal axis of the first bore, the first outside diameter larger than the second outside diameter, which is larger than the third outside diameter; a thrust bearing disposed around the first outside diameter, the thrust bearing having an upper washer and a lower washer, the upper washer having an interference fit with the first outside diameter of the bowl hub; a roller bearing disposed around the third outside diameter, the roller bearing having a separable inner ring from an outer ring and a surrounding cage and roller assembly; a mill base hub extending into the cavity between the bowl and stepped hub, the mill base hub defining a first inside diameter extending to a second inside diameter, which in turn extends to a third inside diameter along a longitudinal axis of the first bore, the first inside diameter larger than the third inside diameter, which is larger than the second inside diameter; and a fluorocarbon rubber oil seal disposed in an annulus of an edge defining the first inside diameter of the mill base hub. The upper washer of the thrust bearing is disposed between the first outside diameter of the bowl hub and the oil seal and first inside diameter of the mill base hub. The second outside diameter of the bowl hub is inside and aligned with the second inside diameter of the mill base hub. The third outside diameter of the bowl hub has an interference fit with the inner ring of the roller bearing, and the third inside diameter of the mill base hub allows the outer ring, cage and roller assembly of the roller bearing to fit therein allowing removal of the bowl hub, inner ring, upper washer and shaft from the mill base hub.

The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION

Figure 2:
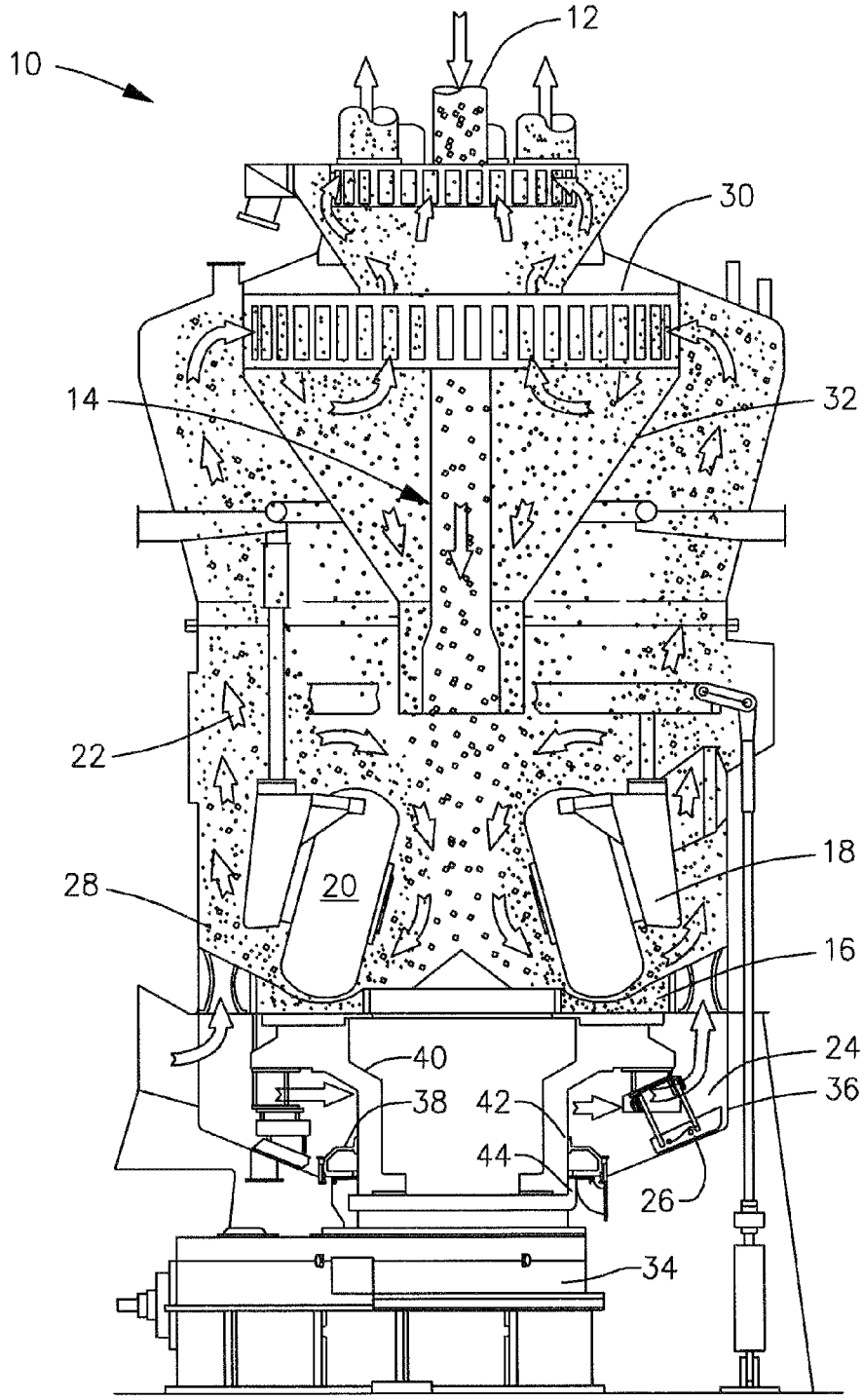
FIG. 2 is a schematic, cross-sectional view of a ring-bowl mill coal pulverizer in accordance with an exemplary embodiment.

FIG. 2 illustrates a schematic, cross-sectional view of a ring-bowl mill coal pulverizer 10 of a conventional type which is suitable for upgrade/retrofit in accordance with an exemplary embodiment. In operation, raw coal 12 enters the center of the pulverizer 10 through a center feed pipe 14. The coal falls onto a rotating bowl 16 which has a replaceable wear surface composed of bull-ring segments. Centrifugal force causes the coal to move outward from the center and under journal assemblies 18, where it is crushed by corresponding large rolls 20. The partially pulverized coal passes over the rim of the bowl 16 and is entrained by a rising hot-air stream 22 and is flash-dried. The pyrites and tramp iron that enter the mill 10 with the coal 12 follow the same path as the coal until the pass over the rim of the bowl 16. Being denser the coal, they cannot be carried upward by the air stream and fall into a millside 24. Once there, these rejected materials are swept around by a set of pivoted scrapers 26 until they reach a tramp-iron opening (not shown). They then fall into a hopper (not shown), external to the mill, which can be emptied with the mill in service.

The air-transported partially pulverized coal 22 enters a vane wheel assembly 28, where initial size classification occurs, with the heavier particles falling back into the bowl 16. The balance of the coal and air stream passes up through the separator body until it reaches a classifier 30. Here, the coal-air mixture begins to spin in a cyclonic path. Externally adjusted vanes control the amount of spin. Because of the differing mass of the particles and the amount of spin, the oversize particles fall into a cone 32 and slide downward until they mix with the incoming, raw coal 12. In this way, only the desired size coal leaves the pulverizer 10. The rotating bowl 16 is driven by a drive gear unit 34 disposed below and external to a mill housing 36. Since the gear unit 34 does not penetrate the mill housing 36, it is not directly exposed to the pulverized coal entrained in the primary air. A mill-housing penetration seal 38 on the grinding-bowl support hub 40 (or yoke), above the gear unit 34 prevents airborne coal particles from settling into the gear unit 34.

Conventionally, the mill-housing penetration seal 38 includes upper and lower labyrinth seals 42, 44. However, such labyrinth seals 42, 44 have been difficult to adjust to maintain the tight tolerances required to prevent introduction of coal particles into the gear unit 34. Alternatively, as discussed above, the mill-housing penetration seal 38 may include a mill base seal ring and a bronze mill base hub bushing (both not shown) disposed between the movable bowl hub and a stationary mill base hub. However, it has also proved difficult to maintain the tight tolerances required to prevent introduction of coal particles into the gear unit 34, as discussed above, with the current bearing/seal assembly and the addition of duct burners.

Figure 1:
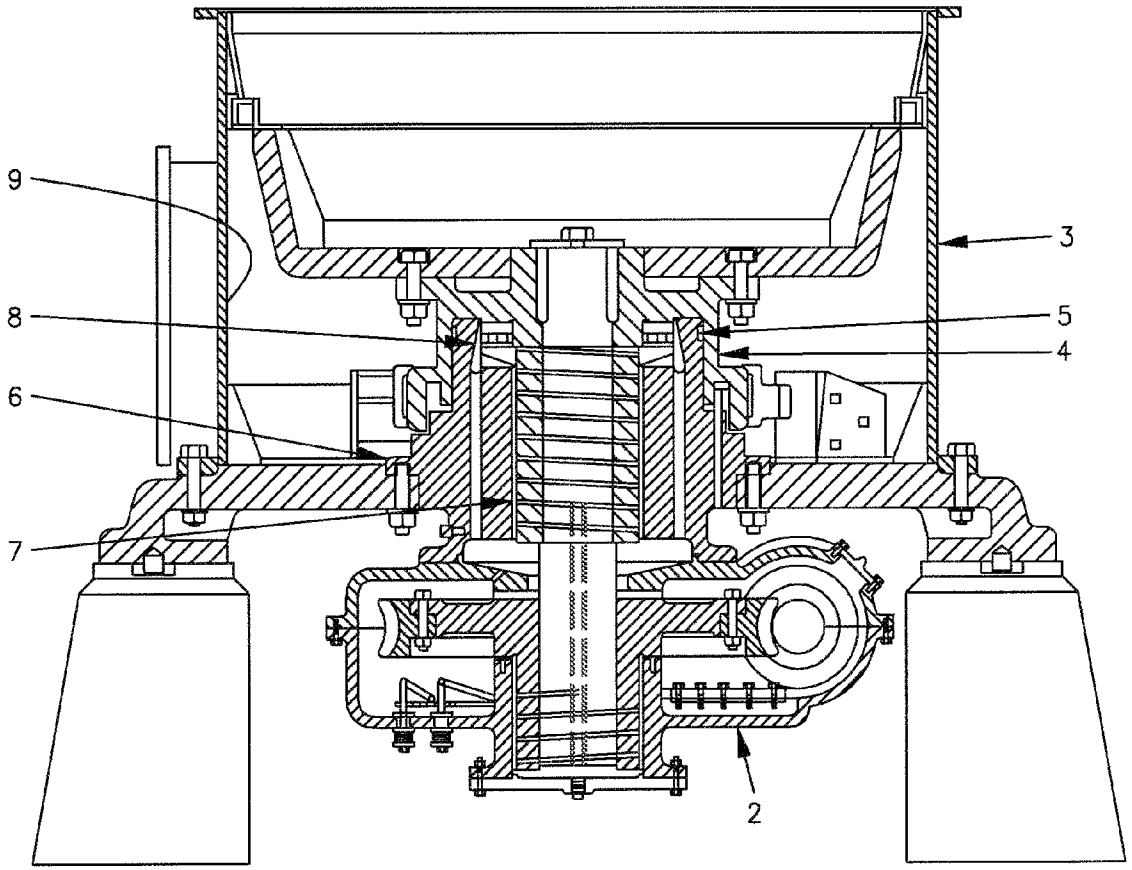
Figure 1 Prior Art
FIG. 1 is a cross-sectional view of a bushing gearbox for a ring-bowl mill coal pulverizer in accordance with the prior art.

FIGS. 3-7 illustrate a pulverizer upper gearbox bearing assembly 100 which represents a low cost upgrade for the replacement of the upper gearbox bushing 7 (FIG. 1) with a roller bearing 102 disposed between a movable bowl hub 104 and a stationary mill base hub 106. Other performance enhancements include a circulating oil system 108 to filter and cool oil supplied to the exemplary roller bearing 102 and existing thrust bearing 8 and a high temperature oil seal 110 to further limit coal contamination in the gear unit 34 (FIG. 2).

Figure 3:
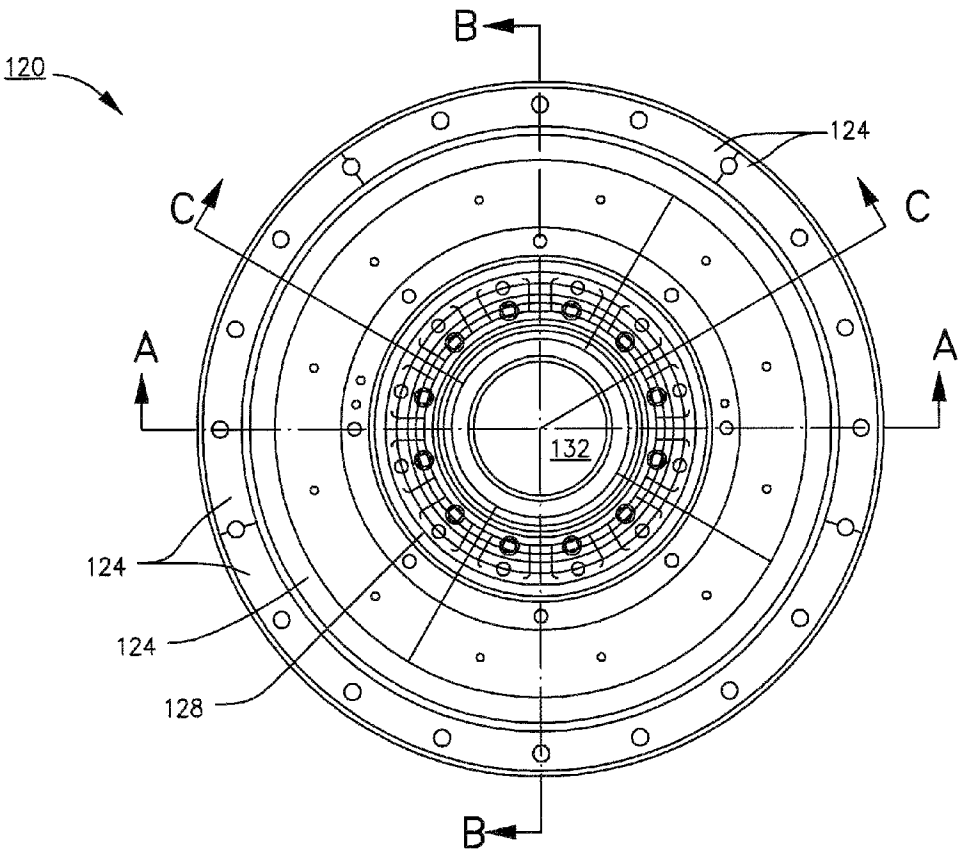
FIG. 3 is a top plan view of an exemplary embodiment of a ring-bowl assembly for explaining the cross section views of FIGS. 4-6 that follow.
Figure 4:
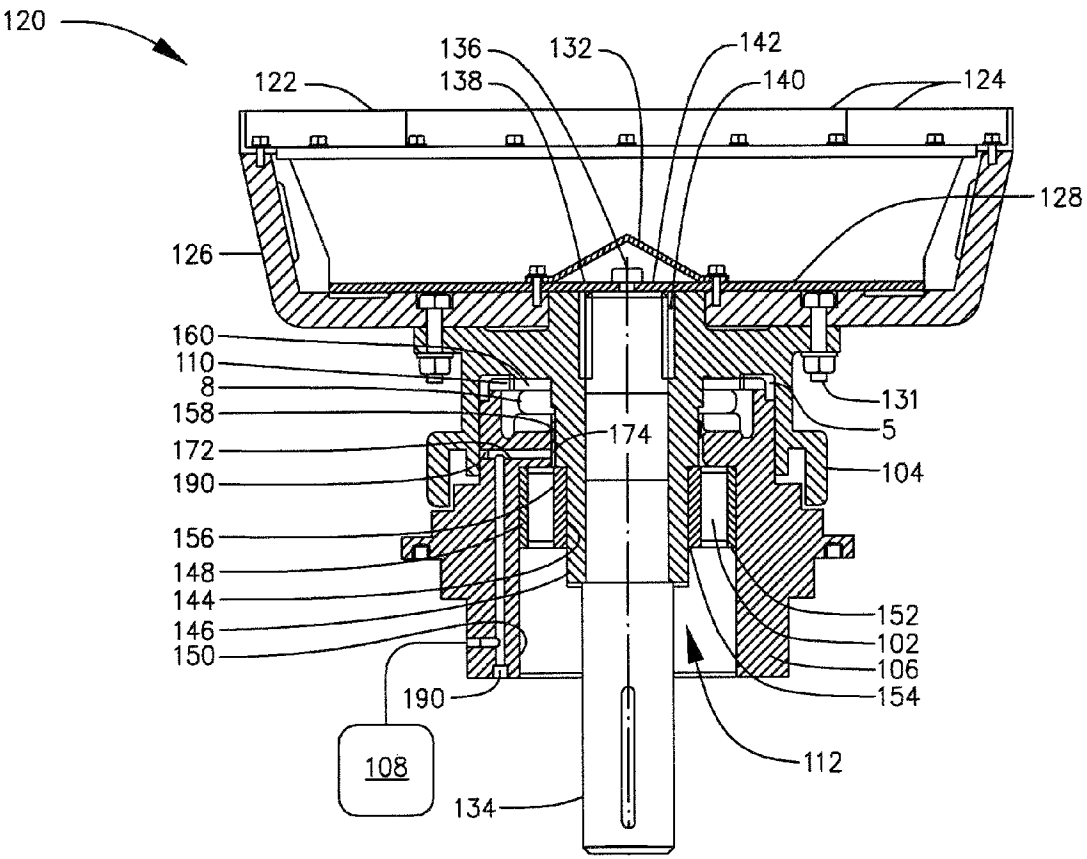
FIG. 4 is a cross section view of the ring-bowl assembly taken along line A-A of FIG. 3.
Figure 5:
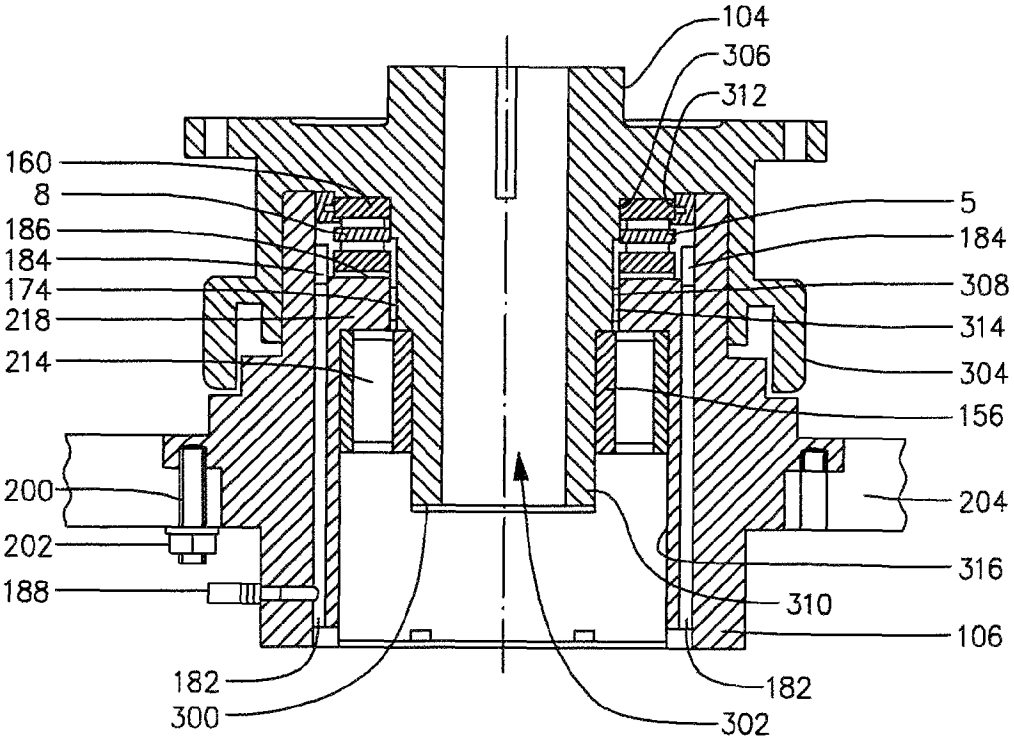
FIG. 5 is a cross section view of the ring-bowl assembly taken along line B-B of FIG. 3.
Figure 6:
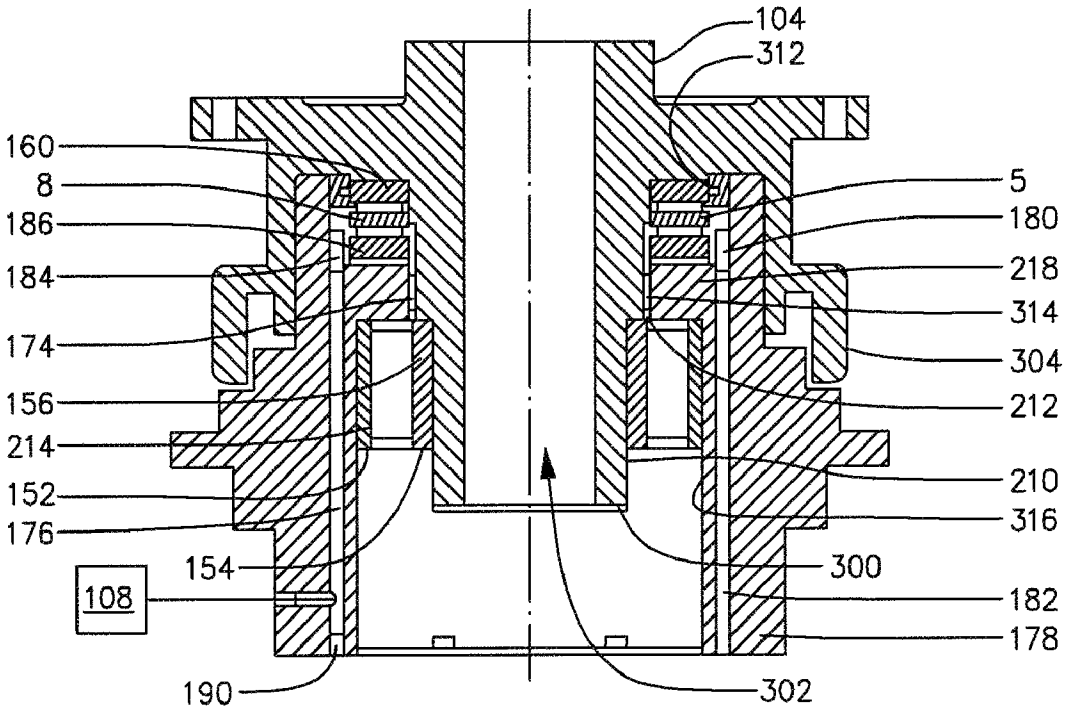
FIG. 6 is a cross section view of the ring-bowl assembly taken along line C-C of FIG. 3.

FIG. 3 is a top plan view of an exemplary embodiment of a ring-bowl 120 assembly for explaining the cross section views of FIGS. 4-6 that follow. FIG. 4 is a cross section view of the ring-bowl assembly 120 taken along line A-A of FIG. 3. FIG. 4 depicts a new high capacity cylindrical roller bearing 102 that replaces the original bronze bushing 7 (FIG. 1) in an upper gearbox 112.

Still referring to FIGS. 3 and 4, the ring-bowl 120 includes a bowl extension ring 122, including five segments 124 (FIG. 3), for example, but not limited thereto, fastened to a peripheral edge defining a bowl 126. Ring-bowl 120 further includes at least one wear plate segment 128 (four shown in FIG. 3) attached to a bottom plate portion defining the bowl 126 using mechanical fasteners 130. The wear plate segments 128 protect the floor of the bowl from coal abrasion. However, before mounting the wear plate segments 128, the bowl 126 is connected to the bowl hub 104 using mechanical fasteners 131.

The mechanical fasteners 130 also attach a vertical shaft cover 132 to the bowl 126 to cover a vertical shaft 134 extending into a central portion of the bowl 126. The vertical shaft 134 is coupled to the bowl 126 using a bolt 136 and a support washer 138 before attaching the vertical shaft cover 132. The bolt 136 threads into one end of the shaft 134 and a pair of opposing dowel pins 140 are inserted between the bowl hub 104 and shaft 134 to prevent rotation of the shaft 134 relative to the bowl hub 104.

In particular, the bowl hub 104 is secured to the vertical shaft 134 by an interference fit and the two dowel pins 140. The bowl hub 104 and shaft 134 are heated uniformly to about 250° F. In an exemplary embodiment, the heating is carried out in an oven or the bowl hub 104 and shaft 134 are wrapped in electric stress relieving blankets (not shown). Once heated, the vertical shaft 134 is stood up and blocked in a vertical position, and the bowl hub 104 is lowered onto the vertical shaft 134. The vertical shaft includes a shoulder 142 which contacts a bowl hub bottom and positions the bowl hub 104 on the shaft 134. Then the washer 138 is installed and bolt 136 is tightened as the resulting assembly cools so that the hub 104 contacts the shoulder 142. When the assembly reaches room temperature, the bolt 136 and washer 138 are removed and two holes (not shown) are drilled about 180° apart from one another on either side of the shaft 134. Each of the drilled holes penetrates a portion of the shaft 134 and bowl hub 104. The two dowel pins 140 are inserted into the drilled holes to prevent the shaft 134 from rotating relative to the bowl hub 104. After the dowel pins 140 are inserted, the bolt 136 and washer 138 may be reinstalled and tightened, preferably using a thread locker.

In order for the roller bearing 102 to fit on the existing bowl hub 104, the bowl hub 104 is modified to create an interference fit between an inner ring bore 144 of the roller bearing 102 and an outside diameter 146 of the bowl hub 104. In addition, the mill base hub 106 is manufactured such that the new bearing outer ring/cage/roller assembly 148 will fit inside a major first inner bore 150 of the mill base hub 106.

Two snap ring retainers 152 and 154 are included to locate and secure the roller bearing 102 with respect to the mill base hub 106 and bowl hub 104.

In order to facilitate maintenance of the new bearing arrangement, the cylindrical roller bearing 102 has an inner ring 156 having an outside diameter less than the small bore diameter defining a second inner bore 158 of the mill base hub. The second inner bore 158 is smaller than the first inner bore of the mill base hub 106. This allows the removal of the bowl 126, bowl hub 104, inner ring 156 of the cylindrical roller bearing 102, small bore (upper) washer 160 of thrust bearing 8 and main vertical shaft 134 from the lower gearbox.

Figure 7:
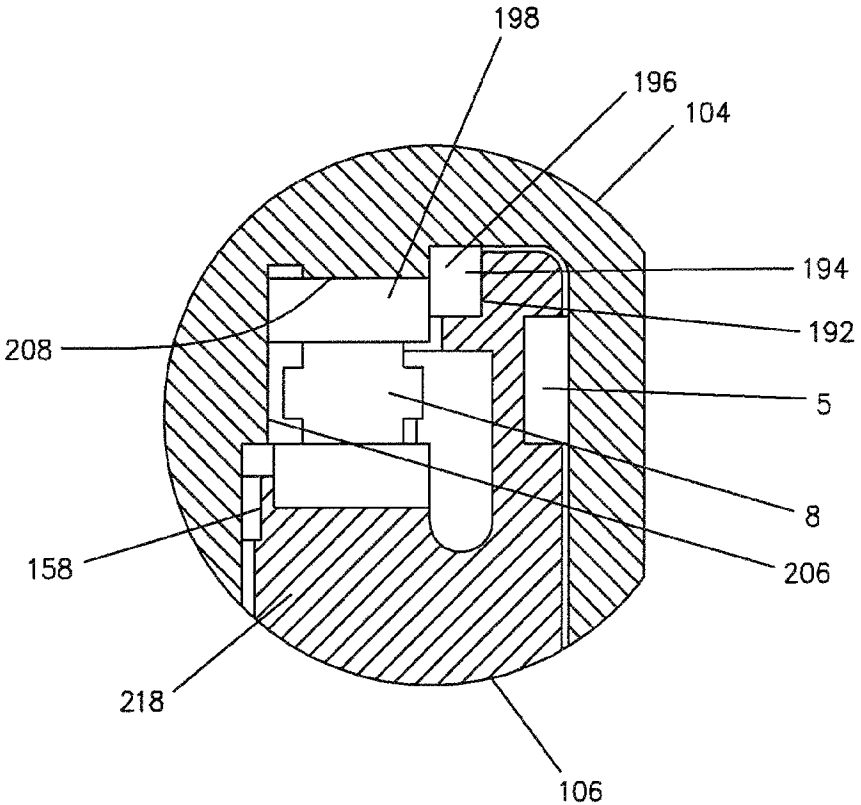
FIG. 7 is an enlarged view of an exemplary embodiment of a bearing assembly illustrated in circled portion E of FIG. 4 to limit egress of coal therethrough.

In more detail and referring to FIGS. 5, 6 and 7, the bowl hub 104 includes a stepped hub 300 defining a first bore 302 to receive the shaft 134 therethrough and a bowl 304 extending radially outwardly therefrom defining a cavity between the stepped hub 300 and bowl 304. The stepped hub 300 has a first outside diameter 306 extending to a second outside diameter 308, which in turn extends to a third outside diameter 310 along a longitudinal axis of the first bore 302. The first outside diameter 306 is larger than the second outside diameter 308, which is larger than the third outside diameter 310. The thrust bearing 8 is disposed around the first outside diameter 306. The upper washer 160 of the thrust bearing 8 has an interference fit with the first outside diameter 306 of the bowl hub 104. The roller bearing 102 disposed around the third outside diameter 310 has a separable inner ring 156 and a unitized outer ring, cage and roller assembly 214.

The mill base hub 106 extends into the cavity between the bowl 304 and stepped hub 300. The mill base hub 106 defines a first inside diameter 312 extending to a second inside diameter 314, which in turn extends to a third inside diameter 316 along a longitudinal axis of the first bore 302. The first inside diameter 312 is larger than the third inside diameter 316, which is larger than the second inside diameter 314. The fluorocarbon rubber oil seal 192 is disposed in an annulus 194 of an edge defining the first inside diameter 312 of the mill base hub 106. The upper washer 160 of the thrust washer 8 is disposed between the first outside diameter 306 of the base hub 104 and the oil seal 192 and first inside diameter 312 of the mill base hub 106. The second outside diameter 308 of the bowl hub 104 is inside and aligned with the second inside diameter 314 defining the mill base hub 106. The third outside 310 diameter of the bowl hub 104 has an interference fit with the inner ring 156 of the roller bearing 102. The third inside diameter 316 of the mill base hub 106 allows the outer ring 214, cage and roller assembly of the roller bearing 102 to fit therein allowing removal of the bowl hub 104, inner ring 156, upper washer 160 and shaft 134 from the mill base hub 106.

In exemplary embodiments, the circulating oil system 108 is included with the new bearing arrangement, described above. The circulating oil system 108 is a forced lubrication system that can be customer supplied or supplied with upgrading/retrofitting the bronze bushing to the cylindrical roller bearing 102. In exemplary forced lubrication systems, the circulating oil is filtered and cooled, and provided to both the thrust and roller bearings 8 and 102.

FIG. 4 also illustrates the mill base hub 106 drilling for the supply and return of this circulating oil from and to a gearbox reservoir (not shown) of the circulating oil system 108. An oil supply port 172 supplies oil just above the cylindrical roller bearing 102. This oil mixes with and cools oil returning from the thrust bearing 8, drains back to the gearbox reservoir (not shown) through an annular space 174 provided between the mill base hub 106 and modified bowl hub 104, passes through and lubricates the cylindrical roller bearing 102 and then flows back into the gearbox reservoir through ports in an upper worm gear housing (not shown).

FIG. 6 illustrates a supply port 176 (left side) and a vent line 178 (right side) for the thrust bearing 8. The height of a vent line standpipe nipple 180 at the end of the vent line 178 assures that air is drawn through this line to equalize the pressure in this cavity and allow proper drainage to occur. FIG. 5 illustrates oil drain ports 182 for the thrust bearing 8. These ports 182 are maintained from the original mill base hub design. The installed height of oil standpipe nipples 184 on these ports 182 assure that the oil level exceeds the height of a lower race 186 of the thrust bearing 8 and that the oil passes through the bearing 8.

FIG. 5 also illustrates a temperature sensor 188 which measures the temperature of the oil returning from the thrust bearing 8. Initially, this temperature measurement is used to set the oil flow rates to each bearing 8 and 102 which result in the lowest return oil temperature. This temperature measurement may be displayed in the control room and may be used to trigger an alert and alarm settings on the mill. In an exemplary embodiment, the temperature sensor is a thermocouple.

FIG. 7 illustrates an exemplary embodiment of a sealing system arrangement provided to limit the ingress of coal contamination into the gearbox oil system 108. The original mill base seal ring 5 is maintained in exemplary embodiments. The seal ring 5 is a steel ring that prevents the majority of coal from being pushed into the gearbox should the pressure in the underbowl area go positive. Additional protection is provided by the addition of a Viton® contact lip seal 192. Viton® seals are made from a fluoroelastomer (e.g., fluorocarbon rubber) which is well known for its excellent (400° F./200° C.) heat resistance. Viton® seals also offer excellent resistance to aggressive fuels and chemicals. The lip seal 192 also prevents loss of excess forced oil through the mill base seal ring 5. A recess 194 is provided in the new mill base hub 106 for this seal 192 and a snap ring 196 locates the seal 192 and prevents it from moving. The seal lip of seal 192 is oriented downward to facilitate installation of the modified bowl hub 104 with an installed upper (small bore) washer 198 of the thrust bearing 8.

Referring to FIGS. 4-7, installation of the mill base hub 106 and bearings 8 and 102 will be described herein below. The bowl hub 104 is inverted or rotated 180° from its orientation in FIG. 4. Shrink fit studs 200 are interference fit into corresponding apertures in the mill base hub 106 until fully seated with threaded ends thereof exposed to receive a respective nut 202 to secure the mill base hub 106 to a mill base 204 (see FIG. 5).

Next, the small bore washer (upper washer) 198 of the thrust bearing 8 is heated to about 200° F. in an oil bath or oven. Once heated, the washer 198 is slid down over an inner largest outside diameter 206 of the bowl hub 104 until it seats against a first bowl hub shoulder 208 (FIG. 7). The thrust bearing cage/roller assembly 8 is then slid over the inner largest outside diameter 206 of the bowl hub 104 until it rests on the installed upper washer 198. This will ensure that the washer 198 remains seated against the bowl hub 104 thrust surface 208 as washer 198 cools. The assembly is allowed to come to room temperature before proceeding. The thrust bearing cage/roller assembly is removed and repacked until ready for use.

Referring to FIG. 6, the inner ring 156 of the cylindrical roller bearing 102 is heated to 200° F., in an oil bath or oven. The inner ring 156 is then slid over an inner smaller outside diameter 210 of the bowl hub 104 until it is seated against a second shoulder 212 of the bowl hub 104 and a uniform weight is applied to the exposed edge face of the inner ring 156 opposite the second shoulder 212 during cooling. The assembly is allowed to come to room temperature before proceeding, at which time the applied weight (not shown) is removed. Then the snap ring retainer 154 is installed.

An outer race 214 of the cylindrical bearing 102 (e.g., outer race/cage/roller assembly) is coated with a light machine oil or WD-40. The outer race/cage/roller assembly is lowered into the mill base hub 106 until the outer race 214 seats on a third shoulder 216 defined by an annulus of the mill base hub support 218 extending from the first inside bore 150 of the mill base hub 106 and disposed between the first and second shoulders 208 and 212 of the bowl hub 104. Then the snap ring retainer 152 is installed.

Three hexagon socket set screws 190 are threaded into oil supply lines using pipe sealant, two set screws are used in the cylindrical bearing supply line and one is used in the thrust bearing supply line as shown in FIGS. 4-6.

The mill base hub 106 is then turned upright to the orientation illustrated in FIG. 4. The large bore washer (lower washer) 186 of the thrust bearing 8 is coated with a light machine oil or WD-40 and then carefully lowered into the mill base hub 106 without hitting the pipe stand vents 180 and 184. The washer 186 is seated directly on a top surface of the mill base hub support 218 and pilots the mill base hub 106 uniformly.

Next, the Viton oil lip seal 192 is pushed into a corresponding cavity in the mill base hub 106 taking care not to damage it. It will be recognized that the lip of seal 192 should be facing down as installed. The oil seal snap ring 196 is then installed in a corresponding cavity in an outside diameter defining the mill base hub 106.

The mill base hub 106 can then be assembled on mill base plate 204 per normal procedures using supplied studs 200 and nuts 202, making sure to position the oil supply holes in the mill base hub 106 in the desired location for ease of lubricant skid attachment. The worm gearbox (not shown) is raised into position making sure that the two oil return holes in the mill base hub bottom flange line up with the slots in the top flange of the upper worm gear housing and is then secured.

The assembled bowl 126, bowl hub 104 and shaft 134 are then positioned over the installed mill base hub 106 and the shaft 134 lowered through the second inner bore 158 of the mill base hub 106. Care is taken not to damage the cylindrical bearing inner raceway surface as it is guided by the thrust bearing lower race ID pilot.

Pipe sealant is applied to the threads of the thermocouple 188 and it is then inserted into oil return line in the mill base hub 106, as illustrated in FIG. 5. Pipe sealant is also applied to all oil supply connections between the mill base hub and lubricant supply skid. The remainder of the mill is assembled per normal procedures.

The above described upgrade or retrofit impacts only the upper section of the bushing gearbox, as the lower gearbox remains unchanged, and hence the lower gearbox has not been shown. This new arrangement allows for the removal of the bowl, bowl hub and main vertical shaft with cylindrical roller bearing inner ring and upper (small bore) thrust bearing washer, through the mill base hub without removing the gearbox. In the above described arrangement, only a new mill base hub and roller bearing are required, as well as a simple modification to the existing bowl hub. In addition, the same upper thrust bearing is used in the new arrangement, and this is another reason why a new bowl hub is not required.

A high capacity cylindrical roller bearing replaces the bronze bushing of the original arrangement to greatly improve load carrying capacity and limit wear inherent with the use of a bronze bushing. The tighter tolerances used in the manufacture of the roller bearing also limit radial play of the main vertical shaft, thus improving running accuracy and reducing shaft misalignment and vibration in the unit.

The design features of the new mill base hub allow for an increase in volume of oil supplied to and returned from the bearings.

Furthermore, the addition of a lip-type oil seal enhances oil sealing and contaminant exclusion in the new arrangement. The orientation of the seal lip at the upper thrust bearing location also helps to direct the oil flow to the drainage cavities and ports and prevents circulating oil leakage out of the system past the original mill base seal ring. The addition of the oil lip seal at the upper thrust bearing location also assists in limiting the ingress of any coal contamination that bypasses the original mill base hub seal ring.

A simple thermocouple may be used to monitor the oil outlet temperature. By monitoring the oil outlet temperature, the oil flow to each bearing can be controlled to achieve the lowest outlet temperature possible and to set alert/alarm points monitored in the control room.

The above-described upgrade/retrofit offers customers a relatively low-cost option to upgrade/retrofit just the upper part of the bushing gearbox to achieve greatly increased performance life of the thrust bearing and upper gearbox. Furthermore, reduced gearbox operating temperatures are achieved due to the forced lubrication system being used to supply filtered and cooled oil directly to each bearing position. Greatly improved oil circulation and cooling is provided due to the creation of a large, annular oil drain area provided in the design of the new mill base hub. Moreover, the original drainage ports are maintained.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A pulverizer upper gearbox bearing assembly for a mill, comprising:

a bowl hub having a stepped hub defining a first bore to receive a shaft therethrough and a bowl extending radially outwardly therefrom defining a cavity between the stepped hub and bowl, the stepped hub having a first outside diameter extending to a second outside diameter, which in turn extends to a third outside diameter along a longitudinal axis of the first bore, the first outside diameter larger than the second outside diameter, which is larger than the third outside diameter;

a thrust bearing disposed around the first outside diameter, the thrust bearing having an upper washer and a lower washer, the upper washer having an interference fit with the first outside diameter of the bowl hub;

a roller bearing disposed around the third outside diameter, the roller bearing having a separable inner ring from an outer ring and a surrounding cage and roller assembly;

a mill base hub extending into the cavity between the bowl and stepped hub, the mill base hub defining a first inside diameter extending to a second inside diameter, which in turn extends to a third inside diameter along a longitudinal axis of the first bore, the first inside diameter larger than the third inside diameter, which is larger than the second inside diameter; and a fluorocarbon rubber oil seal disposed in an annulus of an edge defining the first inside diameter of the mill base hub, wherein the upper washer of the thrust bearing is disposed between the first outside diameter of the base hub and the oil seal and first inside diameter of the mill base hub, the second outside diameter of the bowl hub is inside and aligned with the second inside diameter of the mill base hub, the third outside diameter of the bowl hub has an interference fit with the inner ring of the roller bearing, and the third inside diameter of the mill base hub allows the outer ring, cage and roller assembly of the roller bearing to fit therein allowing removal of the bowl hub, inner ring, upper washer and shaft from the mill base hub.

2. The pulverizer upper gearbox bearing assembly of claim 1, wherein an outside diameter of the inner ring of the roller bearing is smaller than either of the first to third inside diameters of the mill base hub.

3. The pulverizer upper gearbox bearing assembly of claim 2, further comprising a circulating oil system, the mill base hub having supply and return paths for circulating oil supplied to both the thrust bearing and the roller bearing.

4. The pulverizer upper gearbox bearing assembly of claim 3, wherein the circulating oil system supplies oil just above the roller bearing and mixes with and cools oil returning from the thrust bearing, the mixed oil drains back to a gearbox reservoir through an annular space between the mill base hub and bowl hub.

5. The pulverizer upper gearbox bearing assembly of claim 4, wherein the circulating oil system further comprises a temperature sensor, the temperature sensor measures a temperature of the oil returning from the thrust bearing.

6. The pulverizer upper gearbox bearing assembly of claim 5, wherein the temperature sensor is a thermocouple.

7. The pulverizer upper gearbox bearing assembly of claim 5, wherein the temperature sensor is used to set oil flow rates that result in the lowest return oil temperature from the thrust bearing and roller bearing.

8. The pulverizer upper gearbox bearing assembly of claim 7, wherein the oil temperature sensed by the temperature sensor is displayed in a control room and is used to trigger alert or alarm settings on the mill.

9. The pulverizer upper gearbox bearing assembly of claim 1, further comprising a mill base seal ring disposed in a recess on an outside diameter of the mill base hub and abutting an inside wall defining the bowl of the bowl hub.

10. The pulverizer upper gearbox bearing assembly of claim 9, wherein the fluorocarbon rubber oil seal prevents loss of forced oil through the mill base seal ring.

11. The pulverizer upper gearbox bearing assembly of claim 10, further comprising a snap ring to locate and prevent the oil seal from moving.

12. The pulverizer upper gearbox bearing assembly of claim 11, wherein the oil seal includes a seal lip oriented downward to facilitate installation of the bowl hub with the installed upper washer of the thrust bearing.

13. The pulverizer upper gearbox bearing assembly of claim 1, wherein the roller bearing is a cylindrical roller bearing.

* * * * *